US009625870B2

(12) United States Patent
Sumida

(10) Patent No.: US 9,625,870 B2
(45) Date of Patent: Apr. 18, 2017

(54) IMAGE FORMING APPARATUS HAVING PHOTOSENSITIVE MEMBERS AND BLADES IN CONTACT WITH RESPECTIVE PHOTOSENSITIVE MEMBERS

(71) Applicant: Brother Kogyo Kabushiki Kaisha, Nagoya-shi, Aichi-ken (JP)

(72) Inventor: Junya Sumida, Ama (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/084,930

(22) Filed: Mar. 30, 2016

(65) Prior Publication Data

US 2016/0291526 A1 Oct. 6, 2016

(30) Foreign Application Priority Data

Mar. 31, 2015 (JP) ..... 2015-071010

(51) Int. Cl.
*G03G 15/00* (2006.01)
*G03G 21/00* (2006.01)
*G03G 21/10* (2006.01)

(52) U.S. Cl.
CPC ..... *G03G 21/10* (2013.01); *G03G 15/55* (2013.01); *G03G 21/0011* (2013.01); *G03G 2215/0141* (2013.01)

(58) Field of Classification Search
CPC ..... G03G 21/10; G03G 21/0011; G03G 2215/0141
USPC ..... 399/43, 44, 346, 350
See application file for complete search history.

(56) References Cited

U.S. PATENT DOCUMENTS

2010/0080602 A1* 4/2010 Taguma ..... G03G 21/00 399/71
2015/0362884 A1* 12/2015 Komatsu ..... G03G 15/161 399/346

FOREIGN PATENT DOCUMENTS

JP 2001-356642 A 12/2001
JP 2005-106920 A 4/2005
JP 2005-189452 A 7/2005

* cited by examiner

*Primary Examiner* — Hoang Ngo
(74) *Attorney, Agent, or Firm* — Banner & Witcoff, Ltd.

(57) ABSTRACT

An image forming apparatus includes a fixing member, first and second image forming portions, and a processor. In the first and second image forming portions, first and second blades are respectively in contact with first and second photosensitive members. A distance between the first image forming portion and the fixing member is shorter than a distance between the second image forming portion and the fixing member. The processor controls a first image forming portion to perform a toner supply operation in which a first supply member supplies toner amounting to a first quantity per a prescribed rotation amount of the first photosensitive member, and controls the second image forming portion to perform a toner supply operation in which the second supply member supplies toner amounting to a second quantity per the prescribed rotation amount of the second photosensitive member. The second quantity is smaller than the first quantity.

16 Claims, 7 Drawing Sheets

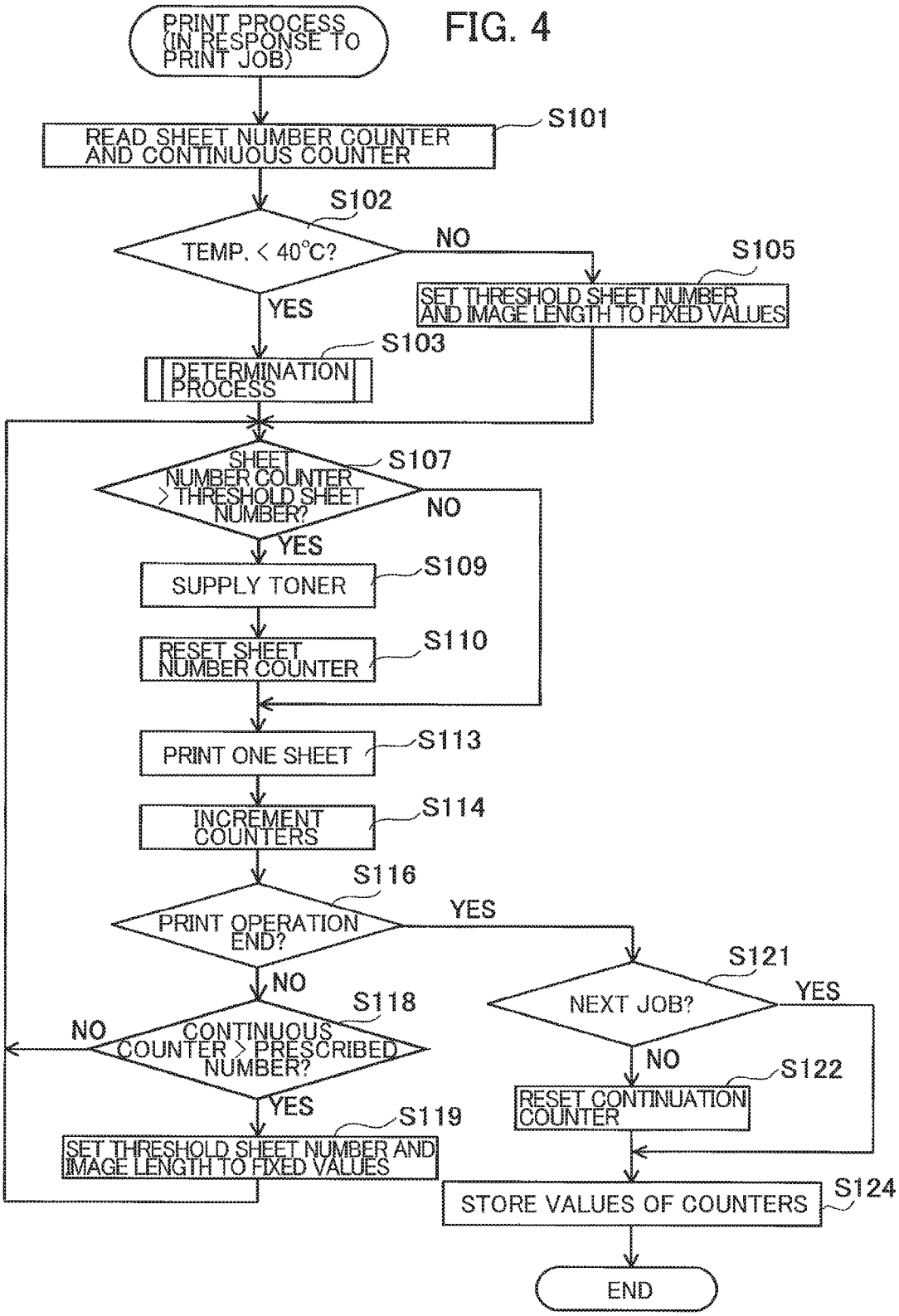
FIG. 4
PRINT PROCESS (IN RESPONSE TO PRINT JOB)
READ SHEET NUMBER COUNTER AND CONTINUOUS COUNTER
S101
S102
TEMP. < 40°C?
NO
S105
SET THRESHOLD SHEET NUMBER AND IMAGE LENGTH TO FIXED VALUES
YES
S103
DETERMINATION PROCESS
S107
SHEET NUMBER COUNTER > THRESHOLD SHEET NUMBER?
NO
YES
S109
SUPPLY TONER
S110
RESET SHEET NUMBER COUNTER
S113
PRINT ONE SHEET
S114
INCREMENT COUNTERS
S116
PRINT OPERATION END?
YES
NO
S118
CONTINUOUS COUNTER > PRESCRIBED NUMBER?
NO
YES
S119
SET THRESHOLD SHEET NUMBER AND IMAGE LENGTH TO FIXED VALUES
S121
NEXT JOB?
YES
NO
S122
RESET CONTINUATION COUNTER
S124
STORE VALUES OF COUNTERS
END

FIG. 6

21

| COLOR | CORRECTION VALUE OF IMAGE LENGTH |
|---|---|
| YELLOW | 0 |
| MAGENTA | 0.3 |
| CYAN | 0.5 |
| BLACK | 2 |

FIG. 7

22

| COLOR | CORRECTION VALUE OF IMAGE LENGTH |
|---|---|
| YELLOW | 0 |
| MAGENTA | 0 |
| CYAN | 0 |
| BLACK | 2 |

FIG. 8

23

| COLOR | CORRECTION VALUE OF THRESHOLD SHEET NUMBER |
|---|---|
| YELLOW | 0 |
| MAGENTA | −10 |
| CYAN | −20 |
| BLACK | −30 |

FIG. 9

24

| COLOR | CORRECTION VALUE OF THRESHOLD SHEET NUMBER |
|---|---|
| YELLOW | 0 |
| MAGENTA | 0 |
| CYAN | 0 |
| BLACK | −30 |

FIG. 10

25

| COLOR | CORRECTION VALUE OF THRESHOLD SHEET NUMBER | CORRECTION VALUE OF IMAGE LENGTH |
|---|---|---|
| YELLOW | −10 | −0.5 |
| MAGENTA | −10 | 0 |
| CYAN | −20 | 0 |
| BLACK | −20 | 0.6 |

IMAGE FORMING APPARATUS HAVING PHOTOSENSITIVE MEMBERS AND BLADES IN CONTACT WITH RESPECTIVE PHOTOSENSITIVE MEMBERS

CROSS REFERENCE TO RELATED APPLICATION

This application claims priority from Japanese Patent Application No. 2015-071010 filed Mar. 31, 2015. The entire content of the priority application is incorporated herein by reference.

TECHNICAL FIELD

The present disclosure relates to an image forming apparatus in which toner carried on a photosensitive member is collected by a blade, a method for controlling the image forming apparatus, and a storage medium storing a program for controlling the image forming apparatus. More specifically, the disclosure relates to a technology for reducing frictional resistance between the photosensitive member and the blade.

BACKGROUND

According to a conventional electro-photographic type image forming apparatus, a cleaning blade is in contact with a photosensitive member to scrape off residual toner remaining on the photosensitive member after image transfer. Here, temperature of the cleaning blade is increased and the blade will be softened in accordance with an increase in surface temperature of the photosensitive member. Thus, so called "stick-slip phenomenon" occurs such that an end portion of the blade in contact with the photosensitive member is compressed and shrinks in a rotational direction of the photosensitive body in accordance with the rotation thereof, and the blade returns its original shape because of resiliency upon shrinkage to some extent, and such repeated shrinking and returning causes vibration. Abnormal noise or chatter may occur if some amounts of toner do not remain between the photosensitive member and the blade.

There is known a technique for restraining chattering. For example, in Japanese Patent Application Publication No. 2001-356642, a detection device is provided for detecting ambient temperature of a photosensitive member. A toner image is formed at a non-imaging surface portion of the photosensitive member in accordance with the detected temperature. Thus, toner is supplied to the surface portion in contact with the cleaning blade.

SUMMARY

However, the following problems are recognized by the inventor. That is, in an internal space of the image forming apparatus where the photosensitive member is accommodated, a spot ambient to a fixing device as a heat source becomes high temperature, and a spot far from the fixing device may not receive the heat from the fixing device. Therefore, assuming that a plurality of photosensitive members are provided in the internal space of the image forming apparatus, the surface temperature of the photosensitive member positioned close to the fixing device is higher than that of the photosensitive member positioned remote from the fixing device. Accordingly, reduction in frictional resistance may not be uniform with respect to the all photosensitive members if amount of toner to be supplied to each photosensitive member is uniform. More specifically, chattering of the blade cannot be restrained with respect to the photosensitive member close to the fixing device, and excessive amount of toner may be supplied to the photosensitive member positioned remote from the fixing device.

It is an object of the present disclosure to overcome the above-described problems, and to provide an image forming apparatus provided with a plurality of photosensitive members and a plurality of blades each in contact with corresponding photosensitive member, the apparatus being capable of reducing frictional resistance between each photosensitive member and corresponding blade, and restraining variation in frictional resistance reduction effect irrespective of positions of photosensitive members.

Another object of the present disclosure is to provide a method for controlling the image forming apparatus to reduce frictional resistance between each photosensitive member and each blade, and to restrain variation in frictional resistance reduction effect irrespective of positions of photosensitive members.

Still another object of the present disclosure is to provide a storage medium storing a program capable of executing a control the image forming apparatus to reduce frictional resistance between each photosensitive member and each blade, and to restrain variation in frictional resistance reduction effect irrespective of positions of photosensitive members.

In order to attain the above and other objects, the disclosure provides an image forming apparatus. The image forming apparatus includes a first image forming portion, a second image forming portion, a fixing member, and a processor. The first image forming portion includes a first photosensitive member, a first supply member, and a first blade. The first photosensitive member is configured to rotate. The first supply member is configured to supply toner of first color to the first photosensitive member. The first blade is in contact with the first photosensitive member. The second image forming portion includes a second photosensitive member, a second supply member, and a second blade. The second photosensitive member is configured to rotate. The second supply member is configured to supply toner of second color to the second photosensitive member. The second blade is in contact with the second photosensitive member. The fixing member is configured to thermally fix toner on a sheet. The fixing member, the first image forming portion, and the second image forming portion are arranged in such a positional relation that a distance between the first image forming portion and the fixing member is shorter than a distance between the second image forming portion and the fixing member. The processor is configured to perform: controlling, while the image forming operation by the first image forming portion is not performed, the first image forming portion to perform a toner supply operation in which the first supply member supplies, to the first photosensitive member, toner amounting to a first quantity per a prescribed rotation amount of the first photosensitive member; and controlling, while the image forming operation by the second image forming portion is not performed, the second image forming portion to perform a toner supply operation in which the second supply member supplies, to the second photosensitive member, toner amounting to a second quantity per the prescribed rotation amount of the second photosensitive member, the first quantity being larger than the second quantity.

BRIEF DESCRIPTION OF THE DRAWINGS

The particular features and advantages of the disclosure as well as other objects will become apparent from the following description taken in connection with the accompanying drawings, in which:

FIG. 4 is a flowchart illustrating a printing process in the printer according to the embodiment;

FIG. 6 is a correction table according to a first example in the printer according to the embodiment;

FIG. 7 is a correction table according to a second example in the printer according to the embodiment;

FIG. 8 is a correction table according to a third example in the printer according to the embodiment;

FIG. 9 is a correction table according to a fourth example in the printer according to the embodiment; and FIG. 10 is a correction table according to a fifth example in the printer according to the embodiment.

DETAILED DESCRIPTION

A printer 100 as an example of an image forming apparatus according to one embodiment will be described with reference to drawings.

Figure 1:
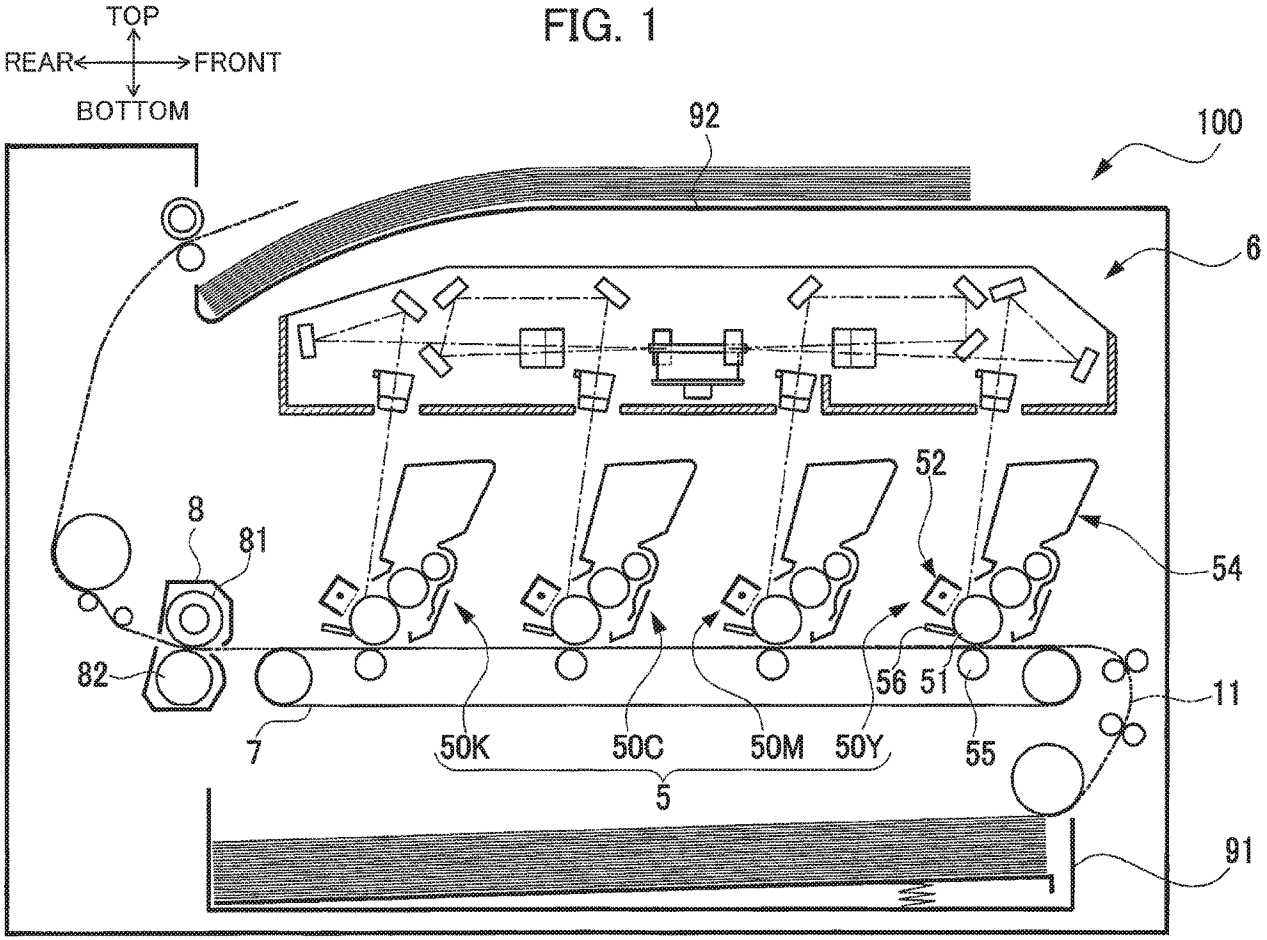
FIG. 1 is a schematic cross-sectional view of a printer as an example of an image forming apparatus according to one embodiment.

The printer 100 is an electro-photographic type color printer, and includes a process portion 5, an exposure unit 6, a conveyer belt 7, and a fixing device 8 as shown in FIG. 1. The process portion 5 includes a process unit 50Y for a color of yellow, a process unit 50M for a color of magenta, a process unit 50C for a color of cyan, and a process unit 50K for a color of black. These process units are arrayed in line with a constant space between neighboring process units. Each of the process units 50Y, 50M, 50C and 50K is an example of an image forming member. The fixing device 8 is an example of a fixing member.

As shown in FIG. 1, the yellow process unit 50Y includes a photosensitive drum 51, a charger 52 positioned beside a peripheral surface of the photosensitive drum 51, a developing unit 54, a transfer device 55, and a blade 56. Remaining process units 50M, 50C, 50K are the same as the yellow process unit 50Y except for colors of toner. For example, these process units have diameters of the photosensitive drums 51 identical to one another. The developing unit 54 is an example of a supply member.

The printer 100 further includes a sheet supply tray 91 to accommodate sheets for a subsequent printing operation (for example, a toner transferring operation), and a discharge tray 92 for receiving a sheet on which an image has been formed. A generally S-shaped sheet passage 11 is provided as indicated by two dotted chain line in FIG. 1, and a plurality of conveyer rollers are provided along the sheet passage 11. That is, each one of the sheet is conveyed from the sheet supply tray 91 to the discharge tray 92 along the sheet passage 11 by the conveyer rollers and the conveyer belt 7.

In the image forming operation, the photosensitive drum 51 is charged by the charger 52, and is exposed to light by the exposure unit 6. Thus, an electrostatic latent image based on print data is formed on the surface of the photosensitive drum 51. Then, toner is supplied from the developing unit 54 to the electrostatic latent image, thereby forming a toner image on the photosensitive drum 51. Further, the toner image is transferred, by the transfer device 55, from the photosensitive drum 51 to a sheet when the sheet passes between the photosensitive drum 51 and the transfer device 55. Then, the toner image on the sheet is thermally fixed to the sheet by the fixing device 8.

There remains toner on the photosensitive drum 51 after the toner image is transferred to the sheet. The remaining tonner is scraped off by the blade 56. The blade 56 is a cleaning blade made of a resin, and is fixed at a position where one side thereof is in contact with a surface of the photosensitive drum 51. In addition, the blade 56 is in contact with at least an entire toner-supplyable range of the photosensitive drum 51 in an axial direction (or widthwise direction). Here, the tonner within the toner-supplyable range can be supplied to the sheet. With the rotation of the photosensitive drum 51, the contact part of the blade 56 with the photosensitive drum 51 moves relatively to the photosensitive drum 51. Some of the toner scraped off by the blade 56 remains in a space between the blade 56 and the photosensitive drum 51. The toner remaining in the space functions as lubricant.

The blade 56 abuts against the photosensitive drum 51 in a direction counter to a rotation of the photosensitive drum 51. For example, in FIG. 1, the photosensitive drum 51 rotates in a clockwise direction. At the contact portion, the blade 56 is pressed in a direction that has a component opposite to a moving direction of the surface of the photosensitive drum 51 at the contact position.

The fixing device 8 includes a heating roller 81 and a pressure roller 82, and thermally fixes an unfixed toner to a sheet. As illustrated in FIG. 1, the fixing device 8 is disposed downstream of the process portion 5 and the conveyer belt 7 in a conveying direction of the sheet. The black process unit 50K is at the most downstream side out of the process units 50 for respective colors, and is closest to the fixing device 8. Therefore, the periphery of the black process unit 50K tends to be high temperature compared to the process units for other colors. In other words, the photosensitive drum 51 of the process unit 50K is closest to the fixing device from among the photosensitive drums 51 of the process units 50K, 50C, 50M, and 50Y, and thus the temperature of an outer surface of photosensitive drum 51 of the process unit 50 K tends to become higher than those of the photosensitive drums 51 of the remaining process units 50C, 50M, and 50Y.

While performing printing color image, the printer 100 transfers sequentially toner images of respective colors formed on the photosensitive drums 51 onto the sheet so as to superimpose the toner images on the sheet. On the other hand, while performing printing monochromatic image, only a black toner image is formed and is transferred onto the sheet. However, in the printer 100, the photosensitive drums 51 of the process units for all colors simultaneously rotate regardless of the types of image (color image or monochromatic image, for example) to be printed. That is, all of the photosensitive drums 51 rotate even at the time of monochrome printing.

Figure 2:
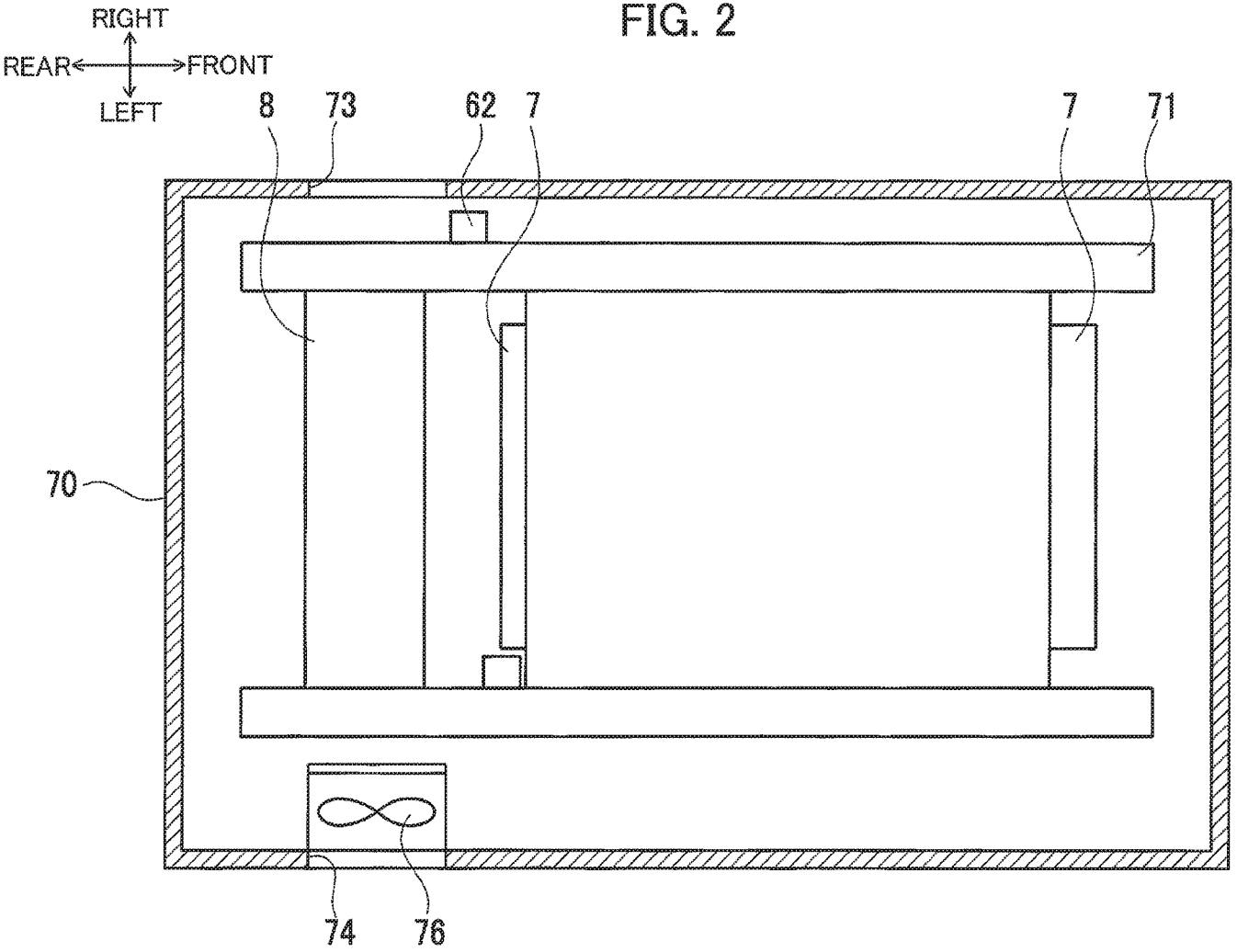
FIG. 2 is a plan view for description of a frame and a temperature sensor in the printer according to the embodiment.

Furthermore, as illustrated in FIG. 2, the printer 100 includes a housing 70 covering the entire printer 100 and a frame 71 supporting the process portion 5. The housing 70 is formed with an intake port 73 and an exhaust port 74, and a fan 76 is disposed inside the exhaust port 74 to discharge air in the printer 100 to the outside thereof. The printer 100 includes a temperature sensor 62 provided near the intake port 73 between the housing 70 and the frame 71.

The temperature sensor 62 outputs different signals depending on a temperature of a space between the housing 70 and the frame 71. Since the temperature sensor 62 is provided near the intake port 73, it is assumed that when printing is not executed by the printer 100, a temperature of air at the position of the temperature sensor 62 is closer to that of air outside of the printer 100. The temperature at any position inside the printer 100 is likely to be equal to or higher than a temperature obtained on the basis of an output signal of the temperature sensor 62.

Figure 3:
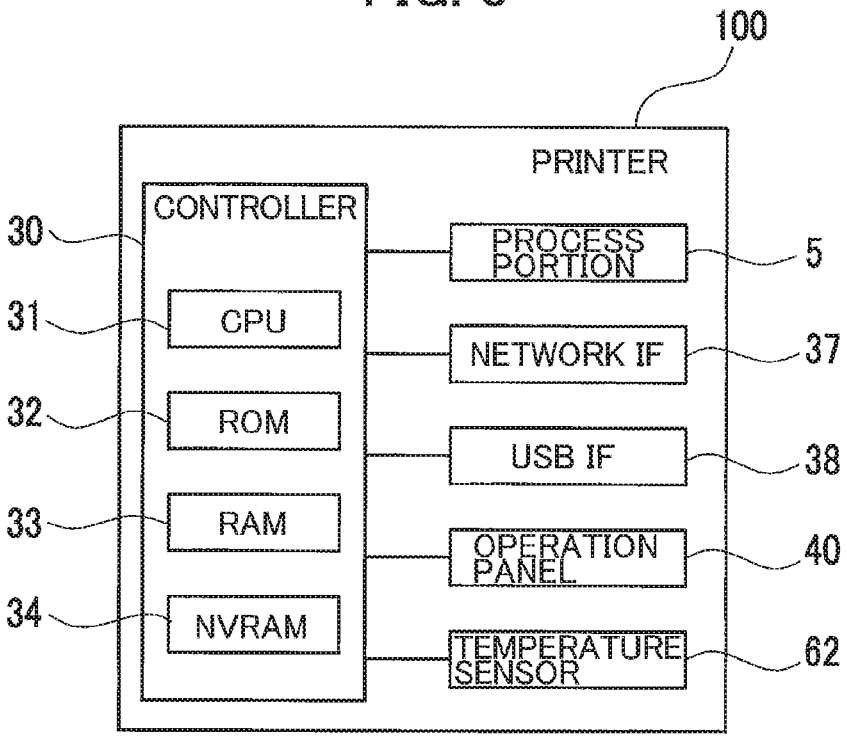
FIG. 3 is a block diagram showing an electrical configuration in the printer according to the embodiment.

Subsequently, an electrical configuration of the printer 100 will be described. As illustrated in FIG. 3, the printer 100 according to this embodiment has a controller 30 including a CPU 31, a ROM 32, a RAM 33, and an NVRAM (non-volatile RAM) 34. In addition, the printer 100 includes the process portion 5, a network interface 37, a USB interface 38, an operation panel 40, and the temperature sensor 62, and these components are electrically connected to the controller 30. The controller 30 illustrated in FIG. 1 is a general term for hardware such as the CPU 31 used for control of the printer 100, and does not necessarily represent single hardware existing actually in the printer 100.

The ROM 32 stores firmware that is a control program for controlling the printer 100, various settings, or initial values. The RAM 33 is used as a work area into which various control programs are read, or as a storage area for temporarily storing image data. The CPU 31 executes various processes according to the control programs read from the ROM 32 or signals sent from various sensors. The CPU 31 controls the respective components of the printer 100 while storing the processed results in the RAM 33 or the NVRAM 34. The CPU 31 is an example of a processor. The controller 30 may be a processor.

The network interface 37 is hardware for communicating with a device connected through a network using a LAN cable. The USB interface 38 is hardware for communicating with a device connected through a USB cable. Furthermore, the operation panel 40 includes a liquid crystal display, and buttons such as a start key, a stop key, and a ten key. The operation panel 40 is hardware for displaying notification to a user and for receiving instruction input by the user.

Subsequently, sounds to be generated in the contact part of the blade 56 with the photosensitive drum 51 in the printer 100 will be described. The blade 56 has high hardness and is hardly deformed in a low-temperature state, but tends to be gradually softened as a temperature rises. When the blade 56 is softened, a stick-slip easily occurs at the contact part of the blade 56 with the photosensitive drum 51. That is, due to the rotation of the photosensitive drum 51, the end of the blade that is in contact with the photosensitive drum 51 is pressed in a rotation direction of the photosensitive drum 51 and the blade 56 is compressed. When the blade 56 is compressed to a certain extent, the blade 54 returns to an original state by an elastic force of the blade 54. The blade 54 is repeatedly compressed and returns to the original state, whereby there are cases in which a vibration occurs and sounds are generated.

Loudness of the sound generated from the contact part of the blade 56 with the photosensitive drum 51 changes depending on softness of the blade 56 and slipperiness between the photosensitive drum 51 and the blade 56. For example, as the temperature of the blade 56 or the photosensitive drum 51 is higher, the blade 56 is softened and the loudness of the sound tends to increase. For example, as the amount of the toner remaining in the contact part of the blade 56 with the photosensitive drum 51 becomes larger, the photosensitive drum 51 easily slips on the blade 56, and thus the loudness of the sound tends to be smaller. That is, the remaining toner functions as lubricant.

Since the fixing device 8 has a heat source, the black process unit 50K disposed near the fixing device 8 easily becomes high temperature compared to the process units 50Y, 50M, and 50C for other colors. In the printer 100, a large amount of toner is supplied to the black process unit 50K than the process units for other colors. When a large amount of toner is supplied to the black process unit 50K than the process units for other colors, the difference in loudness of the sound generated from the contact part of the blade 56 with the photosensitive drum 51 becomes smaller between the black process unit 50K and each of the process units 50Y, 50M, and 50C for other colors.

In order to supply a large amount of toner to the black process unit 50K than the process units for other colors, the CPU 31 executes a toner supply operation for supplying toner to a developing unit 54 at the timing other than the timing when the image is formed. In the toner supply operation, for example, the CPU 31 forms a toner image of a solid image having a proper width over the entire toner-supplyable range, in the axial direction of the photosensitive drum 51. In the printer 100, the photosensitive drum 51 rotates without performing the transfer process by the transfer device 55, and the formed toner image is scraped by the blade 56. When the toner image is formed, and the formed toner image is scraped off by the blade 56, a toner functioning as lubricant is supplied to the contact part of the blade 56 with the photosensitive drum 51.

Some of the toner remaining in the space between the blade 56 and the photosensitive drum 51 pass through the space in association with the rotation of the photosensitive drum 51 or are discharged together with residual toner collected by the blade 56 in the previous transfer process. The amount of toner remaining in the space tends to decrease in association with the rotation of the photosensitive drum 51. Therefore, the printer 100 repeats the toner supply operation with appropriate frequency to appropriately maintain the amount of toner.

Then, the toner supply operation in the black process unit 50K is executed to supply a large amount of toner per a prescribed rotation number (or a prescribed rotation amount) of the photosensitive drum 51 compared to the toner supply operation in the process units 50Y, 50M, and 50C for other colors. The prescribed rotation amount may be a total angle of the rotations by the photosensitive drum 51 for example. For example, when the prescribed rotation number is 10, the total angle of the rotation is 3600 degrees. Specifically, in the printer 100, the frequency of the toner supply operation with respect to the black process unit 50K is higher than that of the toner supply operation with respect to the process units 50Y, 50M, and 50C for other colors. Alternatively, the amount of toner to be supplied once to the black process unit 50K in the toner supply operation is larger than the amount of toner to be supplied once to the process units 50Y, 50M, and 50C for other colors in the toner supply operation. Alternatively, both of the frequency and the amount of toner to be supplied once for the black process unit 50K may be larger than those of the process units 50Y, 50M, and 50C.

In order to realize the toner supply operation described above, a print process in the printer 100 will be described below with reference to a flowchart illustrated in FIG. 4. The print process is executed by the CPU 31 in response to a printing job.

The NVRAM 34 stores a sheet number counter for each color, and a continuation counter used in the print process. Each sheet number counter is a counter for storing the number of printed sheets after the previous toner supply operation of the corresponding color. The sheet number counter is reset at the time when the toner supply operation of the corresponding color is started, and is counted up every time execution of printing. Since the toner supply operation may be executed at different timings for respective colors, the sheet number counter is provided for each color. The continuation counter is a counter for storing the number of sheets to be continuously printed. The continuation counter is reset when there is no next job to be continuously executed at the end of a job, and is counted up every time execution of printing.

In the print process, in S101 the CPU 31 reads the sheet number counter and the continuation counter from the NVRAM 34. In S102 the CPU 31 acquires a temperature based on the output signal of the temperature sensor 62, and determines whether the acquired temperature is lower than 40° C. When the acquired temperature is lower than 40° C., it is estimated that the temperature of air outside of the printer 100 is lower than 40° C. The temperature of 40° C. is an example of a prescribed temperature. The prescribed temperature will be described below. When the acquired temperature is lower than 40° C. (S102: YES), in S103 the CPU 31 executes a determination process to determine a threshold sheet number and an image length for each color.

The threshold sheet number is the number of printed sheets used for determining the execution frequency of the toner supply operation. The CPU 31 compares the threshold sheet number with the sheet number counter described above. At this time, when the number of printed sheets after the previous toner supply operation exceeds the threshold sheet number, the CPU 31 executes again the toner supply operation. That is, as the threshold sheet number is small, the frequency of the toner supply operation is high. Each of the threshold sheet number and the sheet number counter according to this embodiment is number obtained by converting the rotation number (or, the rotation amount) of the photosensitive drum 51 into the number of printed sheets onto a prescribe size of sheet, such as, an A4-sized sheet, for example. A rotation number itself of the photosensitive drum 51 may be counted instead of counting printed sheet. In this case, both of the threshold sheet number and the sheet number counter are set to values indicating the rotation number of the photosensitive drum 51. Both of the threshold sheet number and the sheet number counter may be set to values indicating the total angle of the rotation by the photosensitive drum 51.

The image length indicate a length in a sub-scanning direction of the toner image formed on the photosensitive drum 51 by a single toner supply operation. In the toner supply operation, the printer 100 forms, on the photosensitive drum 51, the toner image of solid image whose length in a circumferential direction of the photosensitive drum 51 is the image length and whose width in the axial direction of the photosensitive drum 51 is a maximum width within which the toner can be supplied (a length of the toner-supplyable range). The solid image has a uniform density of 100% density, for example. That is, as the image length becomes longer, the amount of toner to be supplied by a single toner supply operation becomes larger. According to the embodiment, the image length in the circumferential direction (sub-scanning direction) indicates an amount of toner used when the solid image, which has the image length in the circumferential direction (sub-scanning direction) and the maximum width in the axial direction and has 100% density, is printed. In other words, the image length is a value obtained by converting the amount of toner into a length of the solid image having 100% density in the sub-scanning direction. When the density of the toner image to be formed is not 100%, the image length is a value corresponding to the amount of toner to be supplied based on the density of the image. The image length is an example of a length in the sub-scanning direction while the density of the toner to be supplied is fixed.

Figure 5:
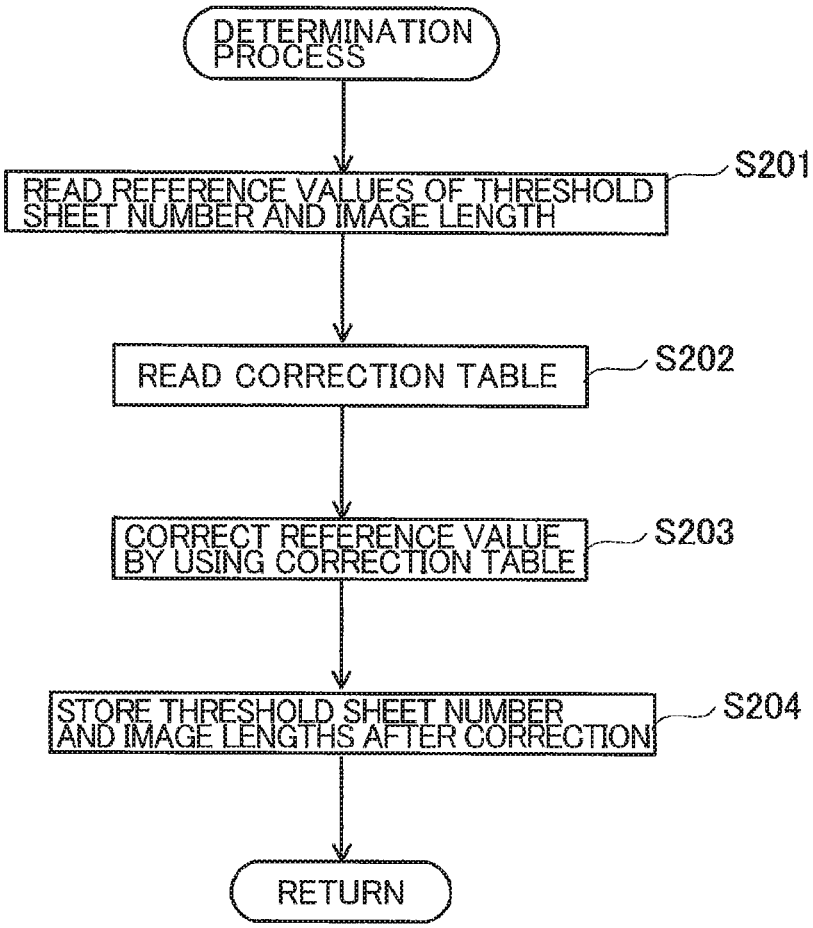
FIG. 5 is a flowchart showing a determination process in the printer according to the embodiment.

Next, the determination process executed by the printer 100 will be described with reference to a flowchart illustrated in FIG. 5. In the determination process, in S201 the CPU 31 reads a reference value of the threshold sheet number and a reference value of the image length from the ROM 32. These reference values are used in common for all colors. The reference value of the threshold sheet number is, for example, 100 sheets, and the reference value of the image length is, for example, 5 mm.

Subsequently, in S202 the CPU 31 reads a correction table for correcting the reference value. The correction table is a table in which correction values are set for respective colors in advance, and is stored in the ROM 32. The correction table may be stored in the NVRAM 34. In the correction table, each numerical value may be a design value or may be a value individually determined for an individual device (the printer 100) on the basis of a test before shipment.

Examples of the correction table read in S202 are illustrated in FIGS. 6 to 10. In each correction table, values are arranged from top to bottom for respective colors of the process units. An order of the values from top to bottom correspond to an order of the process units from upstream to downstream in the conveying direction. That is, as the value is positioned lower in the table, the process unit corresponding to the value is closer to the fixing device 8.

A correction table 21 illustrated in FIG. 6 and a correction table 22 illustrated in FIG. 7 are examples of correction tables that store correction values for respective colors. Each of the correction values is added to the image length (a reference value) that is common for all colors while the threshold sheet numbers of all the colors are set to the reference value. Specifically, the correction value of the image length stored in the correction tables 21 and 22 is greater as the process unit is closer to the fixing device 8. Accordingly, since the image length after the correction is greater as the process unit is closer to the fixing device 8, the larger the amount of toner to be supplied is in a single toner supply operation, the closer the process unit is to the fixing device 8. When the threshold sheet number is common to the respective colors, since the toner supply operations are performed simultaneously for all the colors, the number of the execution timings of the toner supply operations is small. For example, in the case where the printing operation is stopped during the toner supply operation, the number of stops of the printing operation is small.

In addition, a correction table 23 illustrated in FIG. 8 and a correction table 24 illustrated in FIG. 9 are examples of correction tables that store correction values for respective colors. Each of the correction values is added to the threshold sheet number (a reference value) that is common for all colors while the image lengths of all the colors are set to a reference value. Specifically, the correction value stored in the correction tables 23 and 24 is smaller as the process unit is closer to the fixing device 8. Accordingly, since threshold sheet number after the correction is smaller as the process unit is closer to the fixing device 8, the execution frequency of the toner supply operation is higher as the process unit is closer to the fixing device 8. When the image length is common to the respective colors, since the amount of toner supplied in a single toner supply operation can be an optimum amount as a lubricant of the blade 56, waste of the toner is small.

The correction table 21 illustrated in FIG. 6 and the correction table 23 illustrated in FIG. 8 are examples in which correction values are different from each other for respective colors and depend on the distance between the fixing device 8 and the respective process units. When influence of heat reach a range from the black process unit 50K to the cyan process unit 50C or the magenta process unit 50M, and thus the process units for the respective colors have different temperatures, the optimum toner supply operation can be performed for the respective colors by using the correction table 21 or the correction table 23.

On the other hand, the correction table 22 illustrated in FIG. 7 and the correction table 24 illustrated in FIG. 9 are examples in which only a value for the black process unit 50K closest to the fixing device 8 is corrected so as to supply a large amount of toner compared to other colors, and values of the process units for colors other than the black are maintained to a reference value. When only the black process unit 50K is greatly influenced by heat and other colors are little influenced by the heat, the processes can be facilitated using the correction table 22 or the correction table 24.

In addition, a correction table 25 illustrated in FIG. 10 may be used. The correction table 25 is an example of a correction table that stores correction values for respective colors added to both of the threshold sheet number and the image length. That is, both of the threshold sheet number and the image length may be corrected, and thus amounts of toner supplied per the prescribed rotation number of the photosensitive drum 51 may be different for respective colors.

For example, when the prescribed rotation number of the photosensitive drum 51 corresponds to 100 printed-sheets, the amounts of toner for respective colors supplied per the prescribed rotation number can be compared on the basis of conversion values of the image lengths. Each of the conversion values is obtained so that the image length is divided by the threshold sheet number and the divided value is multiplied by 100. A conversion value is 5 for the reference threshold sheet number of 100 sheets and the reference image length of 5 mm. When the correction is performed using the correction table 25 shown in FIG. 10, in the order of the process units from the upstream in the conveying direction, the conversion value for yellow is 5; the conversion value for magenta is about 5.6; the conversion value for cyan is about 6.3; and the conversion value for black is 7. That is, even when the correction is performed using the correction table 25, the amount of toner to be supplied per the prescribed rotation number of the photosensitive drum 51 can be larger as the process unit is closer to the fixing device 8.

Then, in S203 the CPU 31 corrects the reference value read in S201 for respective colors by using the correction table read in S202. Specifically, for each color, the CPU 31 adds the value(s) of the correction table to the reference value(s). That is, for each color, the CPU 31 adds, to one of the reference threshold sheet number and the reference image length, the corresponding correction value in the correction table, or adds, to both the reference threshold sheet number and the reference image length, the respective values in the correction table, and thus obtains the threshold sheet number and the image length. For example, in the printer 100 using the correction table 21 shown in FIG. 6, the threshold sheet number is 100 sheets for all the colors, and the image length for yellow is 5 mm; the image length for magenta is 5.3 mm; the image length for cyan is 5.5 mm; and the image length for black is 7 mm. In S204, the CPU 31 stores, in the RAM 33, the threshold sheet number and the image lengths for respective colors after the correction, and ends the determination process.

Returning to the print process of FIG. 4, when the CPU 31 judges that the temperature is not lower than 40° C. on the basis of the output signal of the temperature sensor 62 (S102: NO), in S105 the CPU 31 determines the threshold sheet number and the image length to fixed values. When the temperature based on the output signal of the temperature sensor 62 is equal to or higher than 40° C., for example, the temperature becomes high in the whole printer 100. That is, when the temperature based on the output signal of the temperature sensor 62 is equal to or higher than a prescribed temperature, heat from the fixing device 8 hardly makes the temperature differences between the process units. For this reason, in S105, the CPU 31 determines both of the threshold sheet number and the image length to the fixed values common to all the colors.

In particular, when the temperature is equal to or higher than 40° C., each blade 56 is softened, and it is desired to increase the amount of toner supplied in the toner supply operation. Thus, in S105 the fixed values are determined so that the conversion value based on the fixed values is larger than any conversion value based on a reference value and/or a value corrected by using any correction table. In the embodiment, the conversion value based on the fixed values may be 8-9. For example, the threshold sheet number is set to 100 sheets and the image length is set to 9 mm, as the fixed values. Alternatively, the threshold sheet number may be set to 60 sheets and the image length may be set to 5 mm, as the fixed values, for example. Even in the case where the conversion value based on the fixed values is larger than or equal to 18, lubrication performance is little improved, and the toner may be wasted or may cause contamination in the printer 100. Accordingly, the fixed values may be set that the conversion value of the fixed values is smaller than a prescribed value, for example, 18.

In S107 the CPU 31 judges whether each value of the sheet number counters exceeds the threshold sheet number determined in S103 or S105. As described above, the sheet number counters are used for counting the number of printed sheets after the respective previous toner supply operations and the sheet number counters are provided for all colors. In S107, the CPU 31 compares the value of the sheet number counter for each color with the threshold sheet number of the corresponding color. When at least one value of the sheet number counters exceeds the corresponding threshold sheet number, the CPU 31 judges to be "YES" in S107.

When the CPU 31 judges that at least one value of the sheet number counters exceeds the corresponding threshold sheet number (S107: YES), in S109 the CPU 31 executes the toner supply operation for each color whose value of the sheet number counter exceeds the corresponding threshold sheet number. For example, the CPU 31 temporarily stops the printing operation, the CPU 31 controls the process unit of the color whose value of the sheet number counter exceeds the corresponding threshold sheet number to form the toner image corresponding to the image length determined in advance so that the toner image is scraped off by the blade 56. Alternatively, the CPU 31 may not stop the printing operation and increase the distance between the sheets so that the toner supply operation can be executed at a timing when there is no sheet at the process portion, that is, a timing after a preceding sheet has passed the process portion 5 and before a subsequent sheet does not reach the process portion 5. Alternatively, after the end of a print job, the toner supply operation may be executed. S109 is an example of a supply process.

In S110 the CPU 31 resets, to "0", the sheet number counter for each color for which the toner supply operation is executed in S109. After S110 or when the CPU 31 judges that none of the values of the sheet number counters for all colors exceeds the respective threshold sheet numbers (S107: NO), in S113 the CPU 31 performs a printing operation on one sheet. In S114 the printer 100 increments each value of the sheet number counters and the continuation counter one by one. The CPU 31 rotates the photosensitive drums 51 for all the colors during the printing operation, and thus increments the values of the counters for all the colors every time one sheet is printed.

In S116 the CPU 31 judges whether the printing operation of the current print job is completed. When the CPU 31 judges that the print operation is not completed (S116: NO), in S118 the CPU 31 judges whether the continuation counter exceeds a prescribed number. The continuation counter is a counter for counting the number of continuously printed sheets. When a plurality of jobs are continuously executed, the CPU 31 increments the continuation counter by a cumulative value of sheets which is number of sheets that has been printed on the basis of the plurality of continuously executed print jobs. The value of the continuation counter is the number of printed sheets corresponding to the continuous rotation number of the photosensitive drum 51.

When the CPU 31 judges that the continuation counter exceeds the prescribed number (S118: YES), in S119 the CPU 31 determines the threshold sheet number and the image length to fixed values. The threshold sheet number and the image length determined in S119 are common values for all the colors, and may be the same values as the values determined in S105. The prescribed number is, for example, 1000 sheets, and is stored in the ROM 32.

When the number of printed sheets exceeds the prescribed number or when the continuous rotation number of the photosensitive drum 51 exceeds a prescribed rotation number, the temperature becomes high in the whole printer 100. That is, since this is the same state as a case where the determination is "NO" in S102, a large amount of toner is preferably supplied in the toner supply operation. Therefore, in S119, the threshold sheet number and the image length are set to common values for each color so that the conversion value based on the set threshold sheet number and the set image length is large.

After S119 or when the CPU 31 judges that the continuation counter does not exceed the prescribed number (S118: NO), the procedure returns to S107, and the printer 100 compares each of the sheet number counters with the corresponding threshold sheet number.

On the other hand, when the CPU 31 judges that that the print job is completed (S116: YES), in S121 the CPU 31 judges whether there is a next job to be continuously executed. When the CPU 31 judges that there is no next job (S121: NO), in S122 the CPU 31 resets the continuation counter to "0". When there is no next job, the CPU 31 temporarily stops the rotation of the photosensitive drum 51, and thus the continuous printing operation is interrupted.

After S122 or when the CPU 31 judges that there is the next job (S121: YES), in S124 the CPU 31 stores the value of the sheet number counter and the value of the continuation counter in NVRAM 34, and ends the print process. Subsequently, the CPU 31 executes the print process for the next print job.

As described above in detail, the printer 100 according to the embodiment includes the plurality of process units 50Y, 50M, 50C, and 50K for respective colors and the fixing device 8. Each of the process units includes the photosensitive drum 51 and the blade 56 which come in contact with each other. The printer 100 executes the toner supply operation while the printer 100 does not execute the printing operation. In the toner supply operation, the larger amount of toner per the prescribed rotation number of the photosensitive drum 51 is supplied, the closer to the fixing device 8 the process unit is. A larger amount of toner is supplied as the lubricant for the process unit that is closer to the fixing device 8 and whose temperature becomes higher. Accordingly, generation of the sound becomes uniform for all the process unit. Thus, frictional resistance between the photosensitive drum 51 and the blade 56 can be reduced. And, fluctuations of reduction in frictional resistance due to the positional differences of the photosensitive drums 51 can be reduced. So, chattering of each blade can be suppressed.

While the disclosure has been described in detail with reference to the above embodiments thereof, it would be apparent to those skilled in the art that various changes and modifications may be made therein. For example, the disclosure is applicable to not only the printer but also a apparatus having a function for forming a color image with an electrophotographic method, such as, a copying machine, a multifunction peripheral, and a facsimile machine.

For example, the arrangement order of the process units for respective colors is not limited to the example shown in FIG. 1. In the printer 100, however, since the black process unit 50K is disposed closest to the fixing device 8 according to the embodiment, the occurrence of the sound can be effectively suppressed by the toner supply operation. This is because there is a high possibility for supplying the black toner at the color printing and the monochrome printing, and a larger amount of residual toner of black is also high than other colors after the image transfer.

Furthermore, the temperature sensor 62 may be disposed outside of the frame 71. Moreover, the temperature sensor 62 may be attached to the frame 71 (outer surface of the frame 71, for example) or may be attached to the housing 70.

The judgement based on the temperature sensor 62 (S102) or the judgement based on the number of sheets continuously printed (S118) may be omitted. That is, the determination process in S103 may be executed regardless of the temperature. Furthermore, the threshold sheet number or the image length determined in the determination process in S103 may be used regardless of the number of sheets continuously printed. In S102, the temperature of 40° C. used for comparison is an example, and is not limited thereto.

The solid image is formed with 100% density in the embodiment, but is not limited to 100% density. For example, the amount of toner can be differently supplied as follows. That is, the densities may be varied among the colors while fixing, to a constant value, lengths of the solid image in the sub-scanning direction for all the colors, instead of varying the image lengths of the solid images of 100% density for the colors. For example, the toner image of 100% density may be formed in the toner supply operation of the black, and the toner image of 50% density may be formed in the toner supply operation of other colors. That is, as the process unit is closer to the fixing device 8, the higher density of the toner is supplied and thus a larger amount of toner may be supplied in a single toner supply operation.

All the numerical values of each correction table described in the embodiment are merely examples and are not limited thereto. In the examples using the correction tables 23 and 24, values of the sheet number counters are compared with the respective threshold sheet numbers that are different from each other for respective colors. However, the CPU 31 may calculate reference values by adding different correction values to the values of the sheet number counters for respective colors, and compare the obtained reference values with a prescribed threshold value. In this case, the closer the process unit is to the fixing device 8, the larger the correction value is.

Part of the configuration of the invention implemented in hardware in the embodiment described above may be replaced by software and, conversely, part of the configuration of the invention implemented in software may be replaced by hardware.

The processes in the embodiment are performed by a single CPU, a plurality of CPUs, or a hardware such as ASIC, or any combination thereof. The processes are performed on the basis of the recording medium storing the programs for executing the processes and/or methods.

When all or part of the functions of the present disclosure are implemented with computer programs, the programs can be stored on a computer-readable storage medium (a non-temporary storage medium, for example). The programs may be used on the same storage medium on which they are supplied, or may be transferred to a different storage medium (computer-readable storage medium). The "computer-readable storage medium" may be a portable storage medium, such as a memory card or a CD-ROM; an internal storage device built into the computer, such as any of various ROM or the like; or an external storage device, such as a hard disk drive, connected to the computer.

What is claimed is:

1. An image forming apparatus comprising:

a first image forming portion comprising;

a first photosensitive member configured to rotate;

a first supply member configured to supply toner of first color to the first photosensitive member; and a first blade in contact with the first photosensitive member;

a second image forming portion comprising:

a second photosensitive member configured to rotate;

a second supply member configured to supply toner of second color to the second photosensitive member; and a second blade in contact with the second photosensitive member, a fixing member configured to thermally fix toner on a sheet, wherein the fixing member, the first image forming portion, and the second image forming portion are arranged in such a positional relation that a distance between the first image forming portion and the fixing member is shorter than a distance between the second image forming portion and the fixing member; and a processor configured to perform:

controlling, while an image forming operation by the first image forming portion is not performed, the first image forming portion to perform a toner supply operation in which the first supply member supplies, to the first photosensitive member, toner amounting to a first quantity per a prescribed rotation amount of the first photosensitive member; and controlling, while an image forming operation by the second image forming portion is not performed, the second image forming portion to perform a toner supply operation in which the second supply member supplies, to the second photosensitive member, toner amounting to a second quantity per the prescribed rotation amount of the second photosensitive member, the second quantity being smaller than the first quantity.

2. The image forming apparatus according to claim 1, wherein the processor is further configured to perform determining that a first total quantity of toner supplied in one toner supply operation by the first image forming portion is larger than a second total quantity of toner supplied in one toner supply operation by the second image forming portion to thereby determine that the first quantity is larger than the second quantity.

3. The image forming apparatus according to claim 2, wherein the first supply member has a first axis extending in an axial direction, and the second supply member has a second axis extending in the axial direction;

wherein in one toner supply operation by the first image forming portion, the first supply member supplies toner for the first quantity corresponding to an image having a first length in a sub-scanning direction orthogonal to the axial direction;

wherein in one toner supply operation by the second image forming portion, the second supply member supplies toner for the second quantity corresponding to an image having a second length in the sub-scanning direction; and wherein the processor is further configured to perform determining that the first length is longer than the second length to thereby determine that the first quantity is larger than the second quantity.

4. The image forming apparatus according to claim 2, wherein the processor is further configured to perform determining that a first density of toner supplied in the toner supply operation by the first image forming portion is higher than a second density of toner supplied in the toner supply operation by the second image forming portion to thereby determine that the first quantity is larger than the second quantity.

5. The image forming apparatus according to claim 2, wherein the processor is further configured to perform carrying on a plurality of toner supply operations by the first image forming portion at a first frequency and to perform a plurality of toner supply operations by the second image forming portion at a second frequency; and wherein the processor is further configured to perform determining that the first frequency is higher than the second frequency to thereby determine that the first quantity is larger than the second quantity.

6. The image forming apparatus according to claim 5, wherein the processor is further configured to perform:

calculating a first reference value by adding a first correction value to rotation amount of the first photosensitive member;

carrying on the toner supply operation by the first image forming portion when the first reference value exceeds a threshold value;

calculating a second reference value by adding a second correction value to rotation amount of the second photosensitive member, the second correction value being smaller than the first correction value; and carrying on the toner supply operation by the second image forming portion when the second reference value exceeds the threshold value.

7. The image forming apparatus according to claim 5, wherein the processor is further configured to perform:

carrying on the toner supply operation by the first image forming portion when rotation amount of the first photosensitive member exceeds a first threshold value; and carrying on the toner supply operation by the second image forming portion when rotation amount of the second photosensitive member exceeds a second threshold value larger than the first threshold value.

8. The image forming apparatus according to claim 1, wherein when the first photosensitive member consecutively rotates for a first number, toner is supplied according to the first quantity during the toner supply operation by the first image forming portion, wherein when the first photosensitive member consecutively rotates for a second number larger than the first number, toner is supplied according to a third quantity per the prescribed rotation amount of the first photosensitive member during the toner supply operation by the first image forming portion, the third quantity being larger than the first quantity.

9. The image forming apparatus according to claim 1, wherein when first consecutive rotational number that the first photosensitive member rotates consecutively exceeds a prescribed value, the processor is further configured to perform determining that the first quantity is the same as the second quantity.

10. The image forming apparatus according to claim 1, further comprising a third image forming portion comprising:

a third photosensitive member configured to rotate;

a third supply member configured to supply toner of third color to the third photosensitive member; and a third blade in contact with the third photosensitive member, wherein the fixing member, the second image forming portion, and the third image forming portion are arranged in such a positional relation that a distance between the second image forming portion and the fixing member is shorter than a distance between the third image forming portion and the fixing member;

wherein the processor is further configured to perform controlling the second and third image forming portions to perform respective toner supply operations where toner is equally supplied to respective photosensitive members by the second and third image forming portions according to the second quantity.

11. The image forming apparatus according to claim 1, further comprising a plurality of image forming portions including the first image forming portion and the second image forming portion;

wherein the first image forming portion is closest in position to the fixing member among the plurality of image forming portions;

wherein color of toner in the first image forming portion is black.

12. The image forming apparatus according to claim 1, further comprising:

a frame supporting the first image forming portion and the second image forming portion;

a temperature sensor located outside the frame and configured to output signals representative of temperature, wherein when a signal from the temperature sensor indicates that temperature is higher than a prescribed temperature, the processor is further configured to perform determining that the first quantity is the same as the second quantity.

13. The image forming apparatus according to claim 1, further comprising a plurality of image forming portions including the first image forming portion and the second image forming portion;

wherein the first image forming portion is closest in position to the fixing member among the plurality of image forming portions.

14. The image forming apparatus according to claim 1, further comprising a third image forming portion comprising:

a third photosensitive member configured to rotate;

a third supply member configured to supply toner of third color to the third photosensitive member; and a third blade in contact with the third photosensitive member, wherein the fixing member, the second image forming portion, and the third image forming portion are arranged in such a positional relation that a distance between the second image forming portion and the fixing member is shorter than a distance between the third image forming portion and the fixing member;

wherein the processor is further configured to perform controlling, while an image forming operation by the third image forming portion is not performed, the third image forming portion to perform a toner supply operation in which the third supply member supplies, to the third photosensitive member, toner amounting to a third quantity per the prescribed rotation amount of the third photosensitive member, the third quantity being smaller than the second quantity.

15. A method for controlling an image forming apparatus including: a first image forming portion including; a first photosensitive member configured to rotate; a first supply member configured to supply toner of first color to the first photosensitive member; and a first blade in contact with the first photosensitive member; a second image forming portion including: a second photosensitive member configured to rotate; a second supply member configured to supply toner of second color to the second photosensitive member; and a second blade in contact with the second photosensitive member, and a fixing member configured to thermally fix toner on a sheet, wherein the fixing member, the first image forming portion, and the second image forming portion are arranged in such a positional relation that a distance between the first image forming portion and the fixing member is shorter than a distance between the second image forming portion and the fixing member, the method comprising:

controlling, while an image forming operation by the first image forming portion is not performed, the first image forming portion to perform a toner supply operation in which the first supply member supplies, to the first photosensitive member, toner amounting to a first quantity per a prescribed rotation amount of the first photosensitive member; and controlling, while an image forming operation by the second image forming portion is not performed, the second image forming portion to perform a toner supply operation in which the second supply member supplies, to the second photosensitive member, toner amounting to a second quantity per the prescribed rotation amount of the second photosensitive member, the second quantity being smaller than the first quantity.

16. A non-transitory computer readable storage medium storing a set of program instructions installed on and executed by a computer for controlling an image forming apparatus including: a first image forming portion including; a first photosensitive member configured to rotate; a first supply member configured to supply toner of first color to the first photosensitive member; and a first blade in contact with the first photosensitive member; a second image forming portion including: a second photosensitive member configured to rotate; a second supply member configured to supply toner of second color to the second photosensitive member; and a second blade in contact with the second photosensitive member; and a fixing member configured to thermally fix toner on a sheet, wherein the fixing member, the first image forming portion, and the second image forming portion are arranged in such a positional relation that a distance between the first image forming portion and the fixing member is shorter than a distance between the second image forming portion and the fixing member, the program instructions comprising:

controlling, while an image forming operation by the first image forming portion is not performed, the first image forming portion to perform a toner supply operation in which the first supply member supplies, to the first photosensitive member, toner amounting to a first quantity per a prescribed rotation amount of the first photosensitive member; and controlling, while an image forming operation by the second image forming portion is not performed, the second image forming portion to perform a toner supply operation in which the second supply member supplies, to the second photosensitive member, toner amounting to a second quantity per the prescribed rotation amount of the second photosensitive member, the second quantity being smaller than the first quantity.

* * * * *